United States Patent [19]

Jones et al.

[11] Patent Number: 4,543,157

[45] Date of Patent: Sep. 24, 1985

[54] METHOD AND APPARATUS FOR THE MANUFACTURE OF VARIEGATED PAPER WEBS

[75] Inventors: Harold R. Jones, Groton; Karl F. Saila, Lunenburg, both of Mass.

[73] Assignee: James River Pepperell, Inc., East Pepperell, Mass.

[21] Appl. No.: 551,334

[22] Filed: Nov. 14, 1983

[51] Int. Cl.[4] ..... D21H 5/02

[52] U.S. Cl. ..... 162/134; 162/162; 162/184; 162/265

[58] Field of Search ..... 162/134, 265, 162, 184, 162/266; 118/210, 211, 216, 304, 313

[56] References Cited

U.S. PATENT DOCUMENTS

| | | | |
|---|---|---|---|
| 249,342 | 11/1881 | Hadden . | |
| 293,228 | 2/1884 | Crane . | |
| 330,215 | 11/1885 | Ellis et al. . | |
| 435,684 | 9/1890 | Cornell | 162/265 |
| 443,658 | 12/1890 | Carpenter . | |
| 655,970 | 8/1900 | Friese-Greene . | |
| 1,017,931 | 2/1912 | Waite et al. . | |
| 1,180,149 | 4/1916 | Hercher . | |
| 1,281,951 | 10/1918 | Harper | 162/134 |
| 1,344,570 | 6/1920 | Warren . | |
| 1,573,208 | 2/1926 | Warren . | |
| 1,595,207 | 8/1926 | Mahler et al. . | |
| 1,623,280 | 4/1927 | Smith et al. . | |
| 1,827,923 | 10/1931 | Wildman et al. . | |
| 1,847,269 | 3/1932 | Schur | 162/134 |
| 1,880,827 | 10/1932 | Cornely et al. . | |
| 1,964,567 | 6/1934 | Feeney . | |
| 1,981,803 | 11/1934 | Hedstrom, Jr. . | |
| 2,211,569 | 8/1940 | Irvine . | |
| 2,215,335 | 9/1940 | Parkhill et al. . | |
| 2,573,659 | 10/1951 | Bollaert . | |
| 3,562,098 | 2/1971 | Plumez et al. . | |

*Primary Examiner*—Peter Chin

*Attorney, Agent, or Firm*—Mandeville and Schweitzer

[57] ABSTRACT

The disclosure relates to process and apparatus for the production of variegated paper, especially including but not limited to paper used in the manufacture of simulated caning material. The process involves the indirect application of aqueous dye solutions to a wet paper web, after formation on the wire and passage of the web through the wet press section, but prior to drying. Multiple jet-like streams of a plurality of dye solutions are directed at the surface of a resilient transfer roller, while being oscillated transversely of the web in an asynchronous manner. Jet-like streams of dye solution apply a relatively wide flow pattern to the surface of the transfer roller, and also cause substantial desirable splattering of the dye solution on the roll surface for subsequent transfer to the wet web, as it passes through a pressure nip formed in part by the transfer roller. The equipment and procedure is highly simplified, reliable yet capable of easy in-process control, all while achieving a uniquely desirable end product having a highly randomized, diffuse variegated design pattern.

15 Claims, 3 Drawing Figures

METHOD AND APPARATUS FOR THE MANUFACTURE OF VARIEGATED PAPER WEBS

BACKGROUND AND SUMMARY OF THE INVENTION

In the production of specialty papers, there is substantial demand for the production of webs incorporating variegated coloring. Such webs have a wide variety of end uses, particularly but not necessarily in connection with the achievement of a decorative effect in the ultimate end product.

A variety of procedures have been developed in the past in an effort to produce a desirable quality of variegated paper web on an economical basis. In some instances, efforts have been made to introduce specially colored pulp into the paper making process, as for example was proposed in the Waite et al. U.S. Pat. No. 1,017,931. It has also been proposed to introduce coloring material onto the paper web as it is being formed on the Fourdrinier wire. The latter procedure, however, has not proven to be very successful in practice, as the color tends to contaminate the white water system such that, over time, color is more widely dispersed through the paper that is desired. The Carpenter U.S. Pat. No. 443,658 and Wildman et al. U.S. Pat. No. 1,827,923 are examples of the latter procedure.

The Feeney U.S. Pat. No. 1,964,567 illustrates a technique for the flowing of colorant onto the wet web at the couch roll. The procedure of the Feeney patent, however, is intended to provide a line configuration, and would have very limited ability to achieve a highly variegated design. Risk of contaminating the white water system is also present. The Crane U.S. Pat. No. 293,228 and Ellis et al. U.S. Pat. No. 330,215 reflect efforts to introduce color into the web between the wet press and dryer sections of the paper making line, but the procedures provide only for a highly regularized form of color application, in the nature of printing, which does not produce the desired, highly diffused, randomized coloring effect that is normally desired and sought for.

In accordance with the present invention, a novel and improved procedure and system is provided for the production of variegated paper, which provides for a high degree of control over the nature of the design and variegation and provides for an apparent randomized, highly diffuse pattern, without danger of contamination of the white water system. In accordance with the invention, variegated coloring is applied to a moving paper web at a nip station located downstream of the paper machine wire and, more specifically, between the wet press section and the dryer section, where the paper has an ideal moisture level for receptivity and diffusion of dye through the thickness of the web.

Pursuant to another aspect of the invention, the nip station, at which the variegated coloring effect is applied, includes a resilient transfer roller, located above the web and operative to apply pressure to the web as it traverses the nip. Dye is applied to the surface of the transfer roller, by means of a plurality of jet-like showers, spaced across the width of the transfer roller. Typically, there will be provided at least two such sets or arrays of jet-like showers, each typically discharging a dye of a different color, at each oscillating transversely with respect to the transfer roller. Ideal variegation is achieved by, among other things, oscillating the respective shower arrays at different frequencies and in a manner such that there is periodic overlapping of individual shower streams. The ultimate effect is the appearance of a high order of randomness to the design achieved and a particularly attractive and desirable end product.

In accordance with another and more specific aspect of the invention, a plurality of arrays of jet-like showers of dye solution are arranged above the transfer roller, directing jet-like streams of dye solution against the surface of the roller from a substantial distance. By controlling the pressure of discharge, and the angle at which the jet-like streams contact the transfer roller surface, a wide variety of design effects may be achieved which includes, where desired, a splashing effect, wide and/or narrow, variable-width wandering stripe-like areas, blotch-like areas and the like.

Among other things, the procedure according to the invention provides for the dye solutions to be "randomized" on the surface of the transfer roller and then pressed into the wet web at the roller nip, where further diffusion of the dye through the thickness of the wet web is achieved by reason of the optimum moisture content of the web at that juncture.

Pursuant to another aspect of the invention, a simplified, economical and reliable apparatus is provided for producing a variegated web on a continuous basis. The improved apparatus includes a nip station located between the wet press section and the dryer section of a paper machine and in which the upper roll of the nip station is a resilient transfer roller for the transfer of dyes in variegated patterns onto the still-wet web as it passes through the nip station. As the dye is transferred to the nip, it is thoroughly diffused through the web which, at that point in the paper making procedure is at an optimum moisture content for the purpose, and this diffusion process is aided significantly by the application of rolling pressure at the nip. The distribution of dye in variegated patterns is effected by providing, in conjunction with the transfer roller, a plurality, typically two, of transversely oscillating, multiple orifice dye shower arrays. These shower arrays are spaced a substantial distance from the transfer roller. Multiple jet-like streams of the dye liquid are issued from the multiple orifices, by means of appropriate supply systems, which maintain the dye under controllable pressure, usually different pressures in the individual arrays. Moreover, the shower arrays are mounted, usually adjustably, in such manner as to provide for the direction of the jet-like streams of dye onto the transfer roller surface at different angles, providing for both a variation in the length of travel of the jet-like streams in reaching the roller surface and also a difference in impact of the streams on the surface. The arrangement is such that, by controllable variation of stream pressure and angle of contact with the transfer roller, a wide variety of effects may be achieved, providing for an exceptionally desirable and attractive end product.

The invention is exceptionally useful in the production of specialty papers for use in the manufacture of simulated caning strips. Using web material produced according to the invention enables the end product to closely duplicate natural caning woods.

For a more complete understanding of the above and other features and advantages of the invention, reference should be made to the following detailed description of a preferred embodiment and to the accompanying drawing.

DESCRIPTION OF A PREFERRED EMBODIMENT

Figure 1:
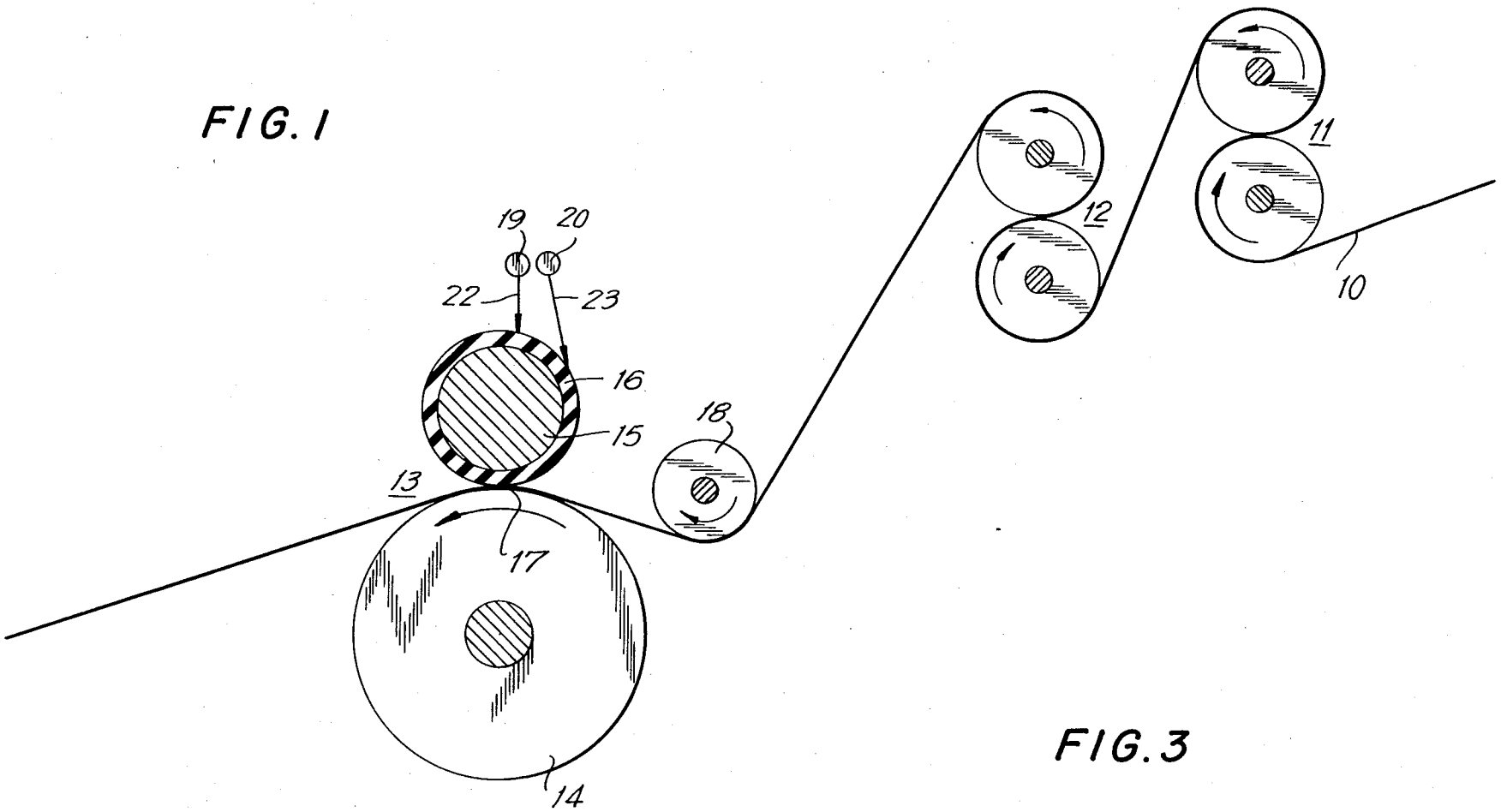
FIG. 1 is a simplified schematic illustration of a portion of a paper making line, from a point downstream of the Fourdrinier or other paper machine to a point upstream of the dryer section.
Figure 3:
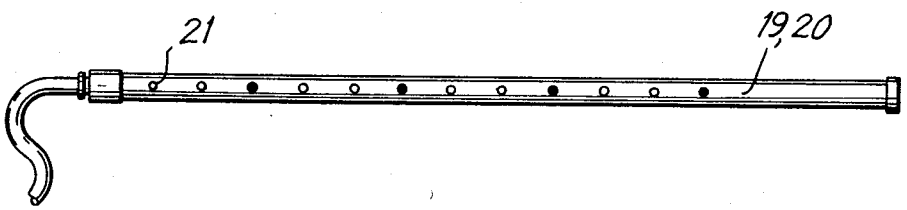
FIG. 3 is a fragmentary elevational view illustrating a dye shower conduit of a type appropriate for utilization in the practice of the invention.

Referring now to the drawing, the reference numeral 10 represents a newly formed, wet paper web at a point shortly downstream of the paper machine, where the web has been lifted off of the paper machine wire and is in a condition of relatively low intregrity and relatively high water content. Typically, at this stage, the web is being supported by a felt to relieve tension strains. The wet web is, in the illustrated arrangement, passed in sequence through wet press stations 11, 12, each consisting of a pair of relatively large diameter nip-forming rollers which function in succession to mechanically reduce the moisture content of the newly formed web. In a typical paper making process, the wet web leaving the second dryer press 12 will have a moisture content generally in the range of from about 40% to about 60% by dry weight of the fiber.

In a standard paper making procedure, the web would be directed from the wet press section into a dryer section consisting of a substantial plurality of heated dryer drums. During passage of the web through the dryer section, most of the remaining moisture is driven out of the web, such that the web emerging at the discharge end of the dryer section is more or less in finished form ready for subsequent conversion operations.

In accordance with the present invention, a nip station, generally designed by the reference numeral 13, is provided between the wet press section 11, 12 and the dryer section (not shown). The nip station includes a lower backing roller 14, typically of steel, which may also be designed to be heated by steam or other heating medium, where desired. Above and cooperating with the steel backing roller is a transfer roller 15 provided with a soft surface covering 16 of rubber or other appropriately resilient material. The respective nip rollers 14, 15 are mounted in a conventional manner, enabling nip pressure to be controllably applied to the partially dewatered web 10 as it passes through the nip 17. One or more entry and/or exit guide rollers 17 may be provided to achieve a proper lead-in to the nip 17, typically to provide for contact of the web with the steel backing roller slightly in advance of and slightly on the exit side of the nip 17.

Mounted above the rubber covered transfer roller 15, on the side thereof opposite the wet web 10, are dye shower conduits 19, 20. These conduits desirably are mounted in parallel relation to the transfer roller 15, extending more or less across the full width thereof at a distance of, for example, about ten inches. Each of the conduits is provided with a series of nozzle forming orifices 21 spaced across the effective operating width of the conduit. The effective operating width of the conduits typically would be slightly less than the width of the web 10, such that dye solution, ejected from the orifices 21, may be applied to the web over substantially its full width, allowing for some degree of transverse oscillation of the respective conduits. Typically, the orifices may be approximately one sixteenth inch in diameter, arranged on a center-to-center spacing of about six inches, for example. For certain design effects, selected ones of the orifices may be plugged, and in one desirable commercial procedure, every third orifice is plugged, providing an especially desirable decorative effect for the end product in question (simulated caning). Typically, the nozzle forming orifices 21 of the respective conduits 19, 20 are aligned along parallel axes, so that jet-like streams of dye solution can be discharged in a common direction from all of the orifices of a conduit. However, within the conceptual scope of the invention, some of the orifices of a given conduit could be related angularly to others.

Figure 2:
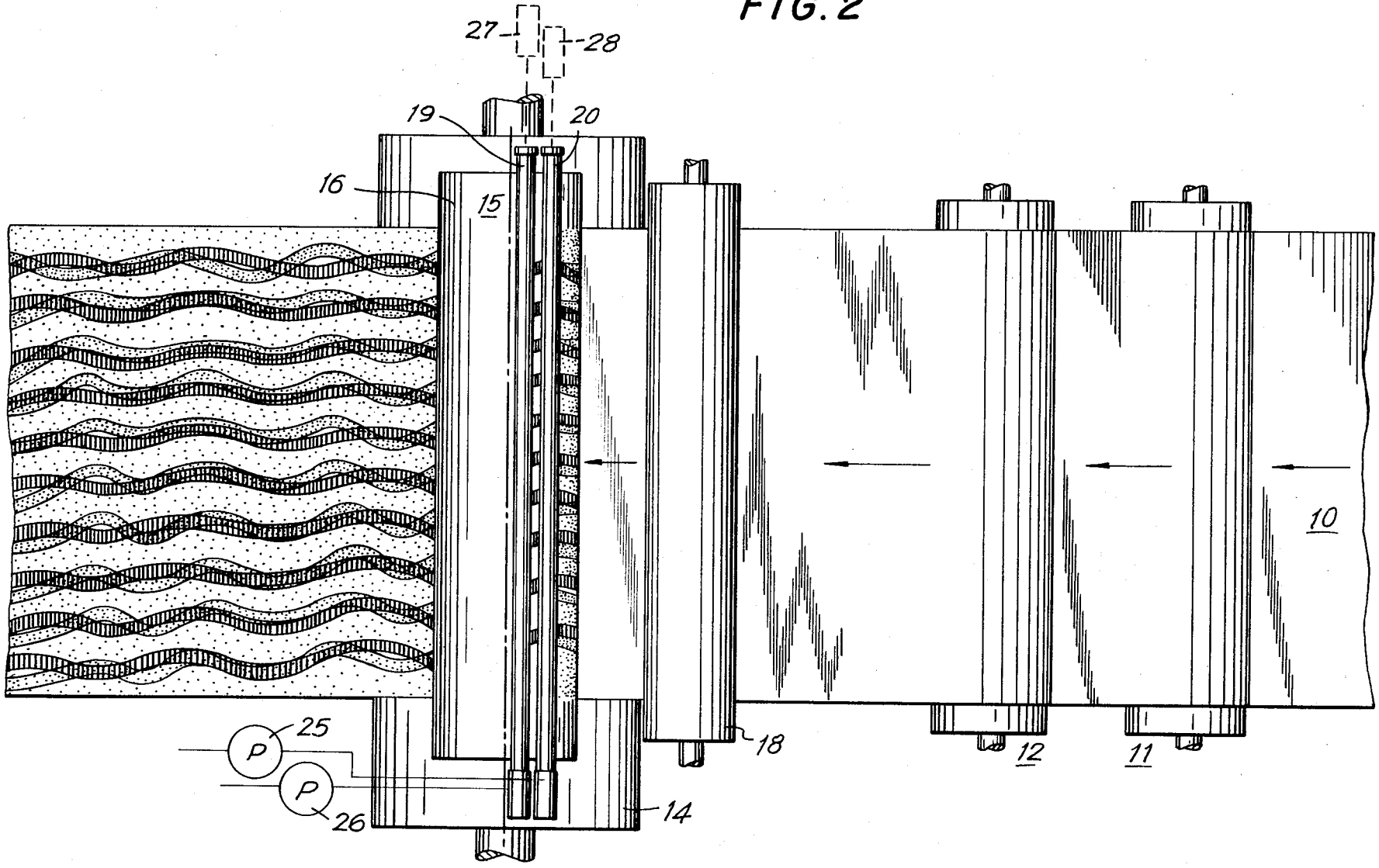
FIG. 2 is a top plan view of a nip roll station utilized in the practice of the invention, illustrating a typical pattern for the application of coloring dyes to the moving paper web.

Pursuant to the invention, the orifices of one of the conduits, constituting a first array of nozzle forming orifices, may be and typically will be disposed at an angle in relation to the orifices of the second conduit, constituting a second array of such orifices. Desirably, the two conduits are mounted more or less in side-by-side relation, as reflected in FIG. 1 and 2, arranged to direct jet-like streams 22, 23 toward the surface of the transfer roller 15. The respective shower conduits 19, 20 are mounted by appropriate means (schematically shown at 27, 28) for controllably oscillating the same at independently adjustable cyclical rates, in a direction transverse to the movement of the paper web 10. The amplitude of oscillation is not critical; typically, it will be somewhat on the order of, perhaps slightly less than the spacing between adjacent nozzle orifices 21. Most desirably, the oscillating means for the respective shower conduits are adjusted to provide slightly differing rates of oscillation of the respective conduits. As will be apparent hereinafter, this achieves the appearance of a high order of "randomness" of the design ultimately produced on the moving web. In fact, the "randomness" may be rather carefully controlled, to enable a satisfactory degree of reproduceability to be achieved in the apparently random design.

It is also contemplated that the respective shower conduits 19, 20 will be mounted for both rotational and transverse adjustment. This enables the orifices 21 of one shower array to be transversely offset from the orifices of the adjacent array, if that is desired, and it allows for controlled adjustment of the angle at which the streams of dye solution, ejected from the orifices 21, strike the surface of the transfer roller 15. It will be further understood, of course, that the orifice spacing of the respective arrays need not be uniform across the full width of the array nor is it necessary that the spacing of one array be the same as that of the other or others. These are functions that may be controlled and, in some cases adjusted, according to the particular end results desired. As will be readily understood, while a substitution of shower conduits 19 or 20 for ones of other orifice size and/or spacing would necessitate temporary disablement of the dye application procedure, many of the other adjustments and process controls may be carried out on a running basis, so that the procedure may be "fine tuned" as necessary to the achievement of the desired design effects.

For typical process applications, the dye solutions delivered to the shower conduits 19, 20 are water-compatible and more typically water-based solutions. As such, they have a viscosity more or less equivalent to that of water. Delivery of the dye solution to the respective shower conduits is provided by adjustable metering pumps, symbolically designated by the reference numerals 25, 26, or other means adaptable to adjustable control of pressure at the shower conduits. In a practical embodiment of the invention, utilizing shower discharge orifices of approximately one sixteenth inch in diameter, working pressures in the range of from about 25 psig to about 40 psig have been found to be desirable. Typically, pressure adjustment is a function of observation of the jet-like streams and a resulting increase in the width of the area covered by the dye solution on the transfer roller. Accordingly, control over the width of the fan to achieve desired design effects may be achieved, in part at least, through pressure control.

In typical practice of the invention, the paper web may have a basis weight in the range of from about 47 to about 85 pounds basis weight (per 3000 square feet). A web suited for the production of simulated caning strip, used in the manufacture of artificial caning for furniture, typically might be around 85 pounds in basis weight, made from a furnish of 25% hardwood, 75% Canadian softwood, for example, having a typical pulp freeness in the range of about 420–460 ml CSF. For such an application, the relatively high basis weight, high strength paper is slit into narrow strips and hard folded to provide a caning strip consisting of four to eight layers of the caning paper. In the production of such papers, the optimum variegating effect is such as to achieve an appearance in the ultimate product of natural caning wood, including knots, blemishes, etc.

For the production of caning papers, the dye solution supplied to each of the shower conduits 19, 20 is a mixture of orange, yellow and black dyes with the following approximate formulation: (a) Pontamine Kraft Orange "A" (Liquid), supplied by Mobay, Inc.; (b) Pontamine Yellow 303 (Liquid), supplied commercially by Mobay Inc.; (c) Elcomine Black GXNOOB (Powder), supplied commercialy by International Dye Stuffs, Clifton, N.J. The approximate proportions and amounts of the foregoing dye components used in the process may be as follows: Orange, 1.2 kg per ton of paper; Yellow, 0.83 kg per ton; Black, 0.03 kg per ton. These formulations are of course illustrative only, and in no way limiting of the concept and scope of the invention.

In the production of commercial caning papers, we have found the above approximate formulation to be highly suitable. The dye solutions supplied separately to the respective shower conduits 19, 20 are varied somewhat, one with respect to the other, providing slightly but noticeably different coloration, depending upon designer objectives.

An ideal effect for caning paper end use is achieved by orienting one of the shower conduits, conduit 20 in the illustration, directly at the axis of the resilient transfer roller 15 while tilting the other shower conduit 19 slightly (e.g., up to about 20°), such that the jet-like streams of dye solution issuing therefrom strike the transfer roller at somewhat of an angle. In the illustrated arrangement, the direction of surface movement of the transfer roller at the point of impingement of the angled dye showers 23 is generally in the direction of discharge of the streams. Fan-out of the streams is controlled by adjustment of pressure to the respective shower conduits 19, 20, by control of the metering pumps 25, 26.

The described arrangement of the shower conduits produces particularly desirable results in the production of caning papers, for example, in that the direct discharge of shower streams 22 from the conduit 20 onto the transfer roll produces a favorable degree of "splashing" and "splattering" of the dye over the surface of the transfer roller, and, to a limited extent, even onto the web itself. In a typical production operation, the respective showers may be so adjusted and operated as to produce relatively wide striping patterns (e.g., approximating four inches) through one set of shower orifices and a relatively narrower striping pattern (e.g., approximating 1–2 inches) by means of the second set of shower orifices. The wider striping pattern typically is achieved with the use of higher discharge pressures, and may advantageously derived through the shower conduit 20, which is oriented directly at the roller, whereby considerable "splattering" of the dye solution is realized. This provides for a continuity of the variegated effect in the areas between the stripe-like patterns, even where, as is usually desired, selected nozzle orifices are plugged.

In accordance with a significant aspect of the invention, the dye solution is first applied to the transfer roller in a highly variegated pattern, which is enhanced by asynchronous oscillation of the respective shower conduits. The dye solutions, which are literally sprayed onto the surface of the transfer roller 15 have an opportunity for somewhat limited random flow and redistribution on the surface of the transfer roller, before being carried to the roller nip, where the dye solution is transferred to and pressed into the wet web. This indirect application of the variegated pattern of dye solution further enhances the "irregularity" of the pattern and results in a greater degree of "randomness" in the end result.

Because of the asynchronous oscillation of the respective shower conduits 19, 20, the "wanderings" of the stripe-like areas applied by the various jet-like showers have the appearance of being highly random, with one shade sometimes overlapping with another to create an entirely different shade. Typical oscillation rates for the respective shower conduits in the practice of the invention may range from around fifteen cycles per minute to around forty cycles per minute, partly as a function of the basis weight of the web and the linear speed of the paper machine. For 80 pound web, for example, the oscillation rate would tend to be at the low end, and at the high end for 47 pound web. In a practical production process, an 80 pound web would involve a line speed of around 410 feet per min., such that the oscillating pattern might have a wave length of around 25 feet.

A significant aspect of the invention is the moisture level of the web at the nip station, where the dye solution is applied and pressed into the web. After passing through the wet press section, the web has a residual moisture content in the range of 40–60%. This provides a relatively optimum condition for the reception and diffusion of the dye solutions, which typically are water-based and in any event are water-compatible. This diffusion is enhanced by the application of rolling pressure by means of the relatively soft transfer roller 15. In typical practice, rolling pressure at the transfer nip 17 advantageously may approximate 39 pounds per linear inch with a resilient surface covering of about 35 durometer (Shore) on the transfer roller.

If desired, temperature control may be provided at the transfer nip 17, by the use of heating medium in connection with the steel backing roller 14. Working temperatures in the range of 60°-100° F. are considered desirable, and quite typically it is acceptable to operate at room temperature without the use of external heating medium at the backing roll.

The procedure and apparatus of the invention enable a unique and highly desirable variegating effect to be achieved in the production of paper while obviating the shortcomings inherent in known procedures and equipment utilized for this purpose. The new procedure achieves a highly randomized (although controllably so) pattern of coloration on and through the web. A high degree of diffusion is achieved without risk of contamination of the white water system. At the same time, the application of the dye solutions by asynchronously oscillating, indirect jet-like sprays completely avoids the "printed on" effect derived from earlier attempts to perform off-wire application of dye solutions.

It should be understood, of course, that the specific procedure and the specific apparatus herein disclosed are intended to be representative, but not limitive, of the invention. Accordingly, reference should be made to the following appended claims in determining the full scope of the invention.

We claim:

1. The process of making controllably randomized variegated paper which comprises (a) continuously forming a moving paper web from a fiber furnish, (b) wet pressing the web to a moisture content of from about 40% to about 60%, (c) directing the pressed web through a roller nip including a transfer roller, (d) continuously applying to said transfer roller at a point remote from said nip a plurality of showers of dye solution, (e) said dye showers being spaced across the width of said web, (f) said dye showers being initially distributed on the surface of said transfer roller, then transferred to said wet web, (g) said dye showers comprising first and second arrays of showers, each such array discharging a separate dye solution, (h) continuously transversely oscillating said arrays of showers with respect to said web, each such array being oscillated on a pattern different from the other, (i) continuously roller pressing said dye solutions, as applied to said transfer roller by said arrays of showers, into said wet web, (j) said dye being diffused through the web as a partial function of the moisture content of said web, and (k) thereafter drying said web.

2. The process according to claim 1, further characterized by (a) said plurality of showers being in the form of small jet-like streams directed at said transfer roller from a sufficient distance to enable said streams to fan out before contacting said roller, (b) said jet-like streams being spaced apart a greater distance than the fanned-out width of said streams.

3. The process of claim 2, further characterized by (a) certain of said jet-like streams being discharged toward said transfer roller at significantly different velocities than other such streams.

4. The process of claim 2, further characterized by (a) certain of said jet-like streams being discharged toward said transfer roller at significantly different angles to the roller surface than others of such streams.

5. The process of making controllably randomized variegated paper which comprises (a) continuously forming a moving paper web by directing an aqueous fiber furnish onto a moving paper-forming wire, (b) removing the web from said paper-forming wire and wet pressing the web to reduce its moisture content to a range of from about 40% to about 60%, (c) directing the thus pressed web through a dye transfer roller nip including a resilient transfer roller, (d) continuously applying to said transfer roller at a point remote from said nip a plurality of jet-like showers of a plurality of water-compatible dye solutions, (e) said jet-like showers being spaced across the width of said web, (f) said dye showers being initially distributed on the surface of said transfer roller, then transferred to said pressed wet web, (g) continuously transversely oscillating said showers with respect to the surface of said transfer roller, and certain of said showers with respect to others thereof, (h) continuously roller pressing said dye solutions, as applied to said transfer roller by said showers, into said wet web, (i) said dye solutions being diffused through the web by reason of the said moisture content of said web, and (j) thereafter drying said web.

6. The process of claim 5, further characterized by (a) said showers comprising at least first and second transversely disposed arrays of jet-like streams of dye, (b) said arrays being transversely oscillated with respect to said transfer roller at differing oscillation rates one with respect to the other, (c) the amplitude of oscillation of said arrays being such that the color patterns of one array at least periodically overlap with the color patterns of the other array.

7. The process of claim 6, further characterized by (a) the jet-like streams of a first one of said arrays being directed at an angle to the plane passing through the center of said transfer roller and extending toward said first array, (b) the jet-like streams of the second of said arrays being directed at an angle with respect to the streams of said first array.

8. The process of claim 7, further characterized by (a) the jet-like streams of said second array being directed substantially toward the axis of said transfer roller.

9. The process of claim 8, further characterized by (a) the streams of said first array being disposed at an angle of up to about 20° with respect to the streams of said second array.

10. The process of claim 5, further characterized by (a) said jet-like streams being discharged toward said transfer roller at a pressure of from about 25 psig to about 40 psig.

11. The process of claim 5, further characterized by (a) maintaining said web under a nip pressure of from about 35 pli to about 45 pli at said dye transfer roller nip.

12. In a paper making line for the manufacture of variegated paper and of the type having a paper-making wire, a wet press section including one or more wet presses, a dryer section, and means for introducing variegated coloring to the paper web, the improvement which comprises (a) means forming a roller nip for the web, (b) said means being located downstream of the wet press section and upstream of the dryer section, (c) the location of said nip forming means being such that the web at said roller nip has a moisture content of from about 40% to about 60%, (d) said roller nip comprising a pair of rollers, including a resilient transfer roller, (e) dye delivery means associated with said transfer roller, including means forming a plurality of nozzle openings spaced across the width of the web, (f) said nozzle forming means being positioned to discharge jet-like streams of dye solution onto said transfer roller from locations spaced from said roller a distance which is substantial in relation to the discharge diameter of said streams, (g) means for supplying water compatible dyes to said nozzle forming means under predetermined pressures, (h) means for transversely oscillating said nozzle forming means with respect to said transfer roller and for effecting oscillatory movement of certain of said nozzle forming means with respect to certain others of said nozzle forming means, (i) means for maintaining predetermined nip pressure at said rollers whereby said dyes are pressed into the wet web and diffused therethrough.

13. The improvement of claim 12, further characterized by (a) said nozzle forming means comprising a plurality of conduit members extending transversely of said web adjacent said transfer roller and located generally on the side thereof opposite said web, (b) said conduit members having nozzle forming openings therein directed generally toward the surface of said transfer roller, (c) means for supplying dye solution under predetermined pressure independently to said conduit members, and (d) means for separately oscillating said conduit members transversely with respect to said web.

14. The improvement of claim 13, further characterized by (a) means mounting said conduit members for limited rotary adjustment about their respective axes for varying the angle at which said jet-like streams impinge upon the surface of said transfer roller.

15. The improvement of claim 12, further characterized by (a) said transfer roller having a soft, resilient surface layer, and (b) the roller opposing said transfer roller being of steel or other relatively nonresilient material.

* * * * *